US008192083B2

(12) United States Patent
Bautista

(10) Patent No.: US 8,192,083 B2
(45) Date of Patent: Jun. 5, 2012

(54) SHOPPING BAG AND METHOD OF USING SAME

(76) Inventor: Ryan Bautista, Brampton (CA)

( * ) Notice: Subject to any disclaimer, the term of this patent is extended or adjusted under 35 U.S.C. 154(b) by 323 days.

(21) Appl. No.: 12/533,630

(22) Filed: Jul. 31, 2009

(65) Prior Publication Data

US 2011/0026857 A1 Feb. 3, 2011

(51) Int. Cl.

| | |
|---|---|
| ***B65D 33/10*** | (2006.01) |
| ***B65D 33/14*** | (2006.01) |
| ***B65D 30/00*** | (2006.01) |
| ***B65D 33/00*** | (2006.01) |

(52) U.S. Cl. ..... 383/9; 383/11; 383/37; 383/95

(58) Field of Classification Search ..... 383/9, 37, 383/95, 11

See application file for complete search history.

(56) References Cited

U.S. PATENT DOCUMENTS

| | | | | |
|---|---|---|---|---|
| 4,031,646 | A * | 6/1977 | de Nouel | 40/359 |
| 4,557,384 | A | 12/1985 | Membrino | |
| 4,966,260 | A * | 10/1990 | Young | 190/111 |
| 4,979,833 | A | 12/1990 | Cook | |
| 5,282,686 | A | 2/1994 | Haber | |
| 5,881,787 | A * | 3/1999 | Davis et al. | 150/103 |
| 7,322,477 | B2 * | 1/2008 | Schweitz | 206/579 |
| 7,412,995 | B2 * | 8/2008 | Arcese | 150/103 |
| 7,721,778 | B2 * | 5/2010 | Hess | 150/119 |
| 2002/0153074 | A1 * | 10/2002 | Chen et al. | 150/113 |
| 2003/0145927 | A1 | 8/2003 | Lee | |
| 2004/0134825 | A1 * | 7/2004 | Navickas | 206/528 |
| 2005/0029133 | A1 * | 2/2005 | Maehashi et al. | 206/308.1 |
| 2005/0072712 | A1 | 4/2005 | Strickland | |
| 2006/0037682 | A1 | 2/2006 | Reiter | |
| 2006/0226204 | A1 * | 10/2006 | O'Leary et al. | 229/67.1 |
| 2011/0081102 | A1 * | 4/2011 | Wang | 383/10 |

FOREIGN PATENT DOCUMENTS

| | | | |
|---|---|---|---|
| CA | 2651515 | A1 | 12/2007 |
| DE | 10138612 | A1 | 11/2002 |
| GB | 2314316 | A | 12/1997 |
| JP | 07257518 | A * | 10/1995 |

OTHER PUBLICATIONS

Web Page "Grommet Tote Bag With Magnetic Closure", 4 pages, dated Jun. 8, 2009.

International Search Report for PCT/CA2010/001026 dated Oct. 19, 2010.

* cited by examiner

*Primary Examiner* — Jes F Pascua

(74) *Attorney, Agent, or Firm* — Honigman Miller Schwartz and Cohn LLP

(57) ABSTRACT

A container which includes a container shell defining an interior therein and having an opening for accessing the interior. A first grommet and a second grommet each are located on the container shell and each include a perimeter that defines an aperture through the grommet. The second grommet including a magnetic or a ferromagnetic material. A first magnet is within the first grommet. The first grommet and the second grommet are positioned on the container shell to assist in closing the opening by magnetic attraction between the first magnet and the magnetic or ferromagnetic material, when the opening is closed the grommets are held in a position wherein the apertures are in general alignment.

19 Claims, 8 Drawing Sheets

SHOPPING BAG AND METHOD OF USING SAME

FIELD

Example embodiments described herein relate generally to retail shopping bags.

BACKGROUND

Disposable paper and plastic shopping bags are often used in the retail trade as a convenience for shoppers, and are often supplied by the retail shop for free or for a small fee. Such bags are often low-cost and mass produced with limited features.

An alternative to disposable bags is a reusable bag. Reusable bags are often purchased for a fee and formed of a relatively strong material and intended for multiple uses. For environmental and policy reasons, reusable bags are becoming the more prevalent retail bag of choice.

As disposable bags are typically lighter and thinner, they may be readily packaged and dispensed. A difficulty with existing reusable bags is that they are typically relatively heavier, thicker, and bulkier, causing difficulties in packaging and for subsequent dispensing. For example, typically shoppers using standard reusable shopping bags have to fumble with them at the check-out counter, and open up their handles at the counter in order to fill them with groceries, which can cause a delay in the through-put at the cashier.

SUMMARY

Some example embodiments relate to a shopping bag and associated method of using same. The bag is for carrying of retail goods, groceries, and the like. The bag generally includes a first pair of magnetic grommets for closing of the bag, as well as for magnetically attracting to like magnetic grommets of like bags. This for example allows stacking of such bags in series, for storing and dispensing of the bags.

In one aspect, there is provided a container, which includes a container shell defining an interior therein and having an opening for accessing the interior, a first grommet and a second grommet each located on the container shell and each including a perimeter that defines an aperture through said grommet, the second grommet including a magnetic or a ferromagnetic material. A first magnet is within the first grommet, the first grommet and the second grommet being positioned on the container shell to assist in closing the opening by magnetic attraction between the first magnet and the magnetic or ferromagnetic material. When said opening is closed said grommets are held in a position wherein said apertures are in general alignment.

In another aspect, there is provided a method of using of a container, the container including a container shell defining an interior therein and having an opening for accessing the interior, a first magnet, and a magnetic or a ferromagnetic material, the first magnet and the magnetic or ferromagnetic material positioned on the container shell to assist in closing the opening by magnetic attraction therebetween, the first magnet being positioned on the container shell to magnetically interact exterior to the container shell. The method includes magnetically attracting the first magnet to a like second container to releasably secure the container shell to the like second container.

In yet another aspect, there is provided a container system, including a first container and a second container. The first container includes a first container shell defining a first interior therein and having a first opening for accessing the first interior, a first magnet, and a first magnetic or ferromagnetic material, the first magnet being positioned on the first container shell to magnetically interact exterior to the first container shell. The second container includes a second container shell defining a second interior therein and having a second opening for accessing the second interior, a second magnet, and a second magnetic or ferromagnetic material, the second magnet being positioned on the second container shell to magnetically interact exterior to the second container shell. The first magnet is magnetically attracted to the second magnet to releasably secure the first container shell to the second container shell.

BRIEF DESCRIPTION OF THE FIGURES

Embodiments will now be described by way of example with reference to the accompanying drawings, in which like reference numerals are used to indicate similar features, and in which.

DETAILED DESCRIPTION OF EXAMPLE EMBODIMENTS

Figure 1:
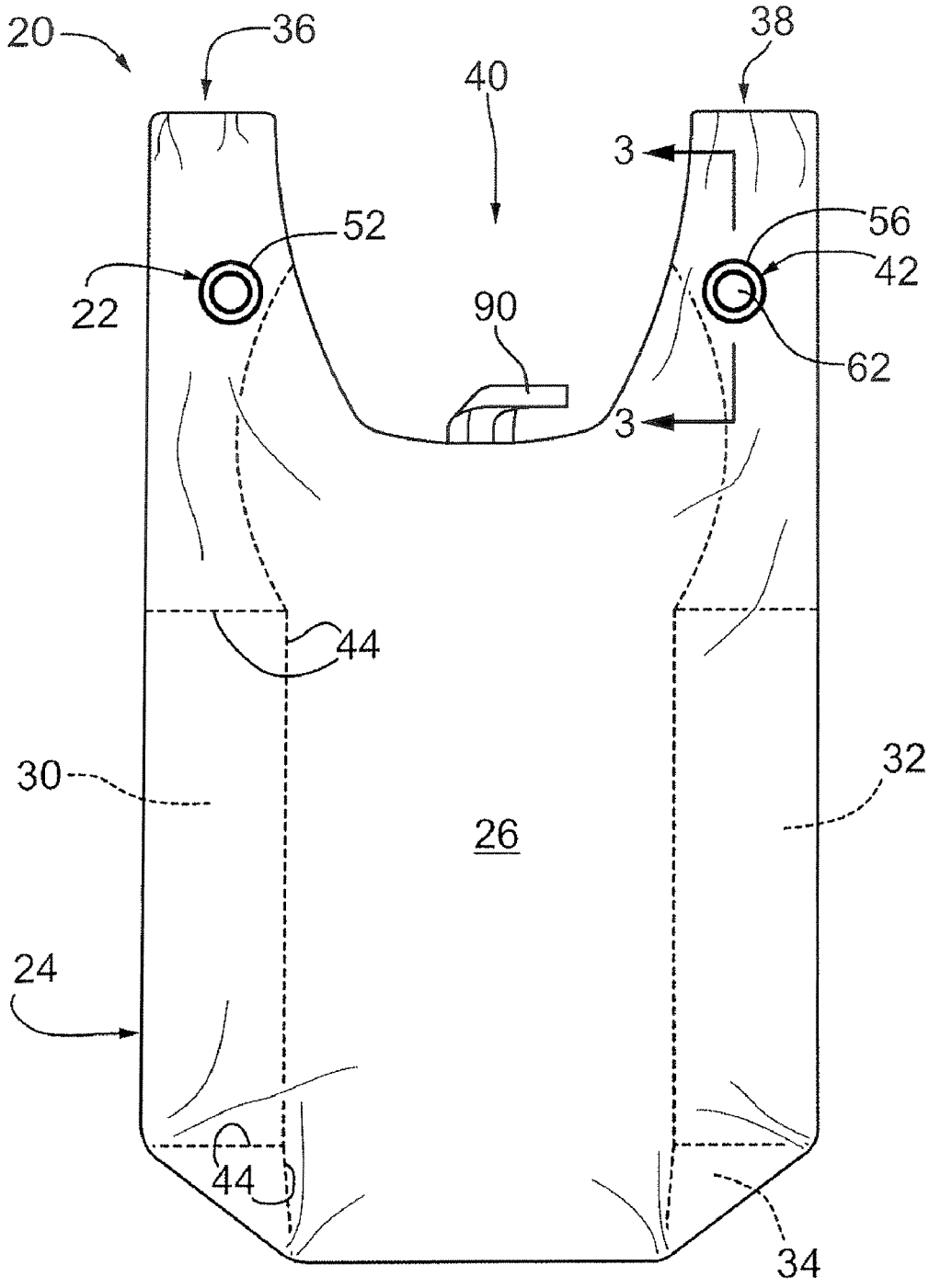
FIG. 1 shows a front side view of a bag in accordance with an example embodiment of the invention in a closed configuration.
Figure 2:
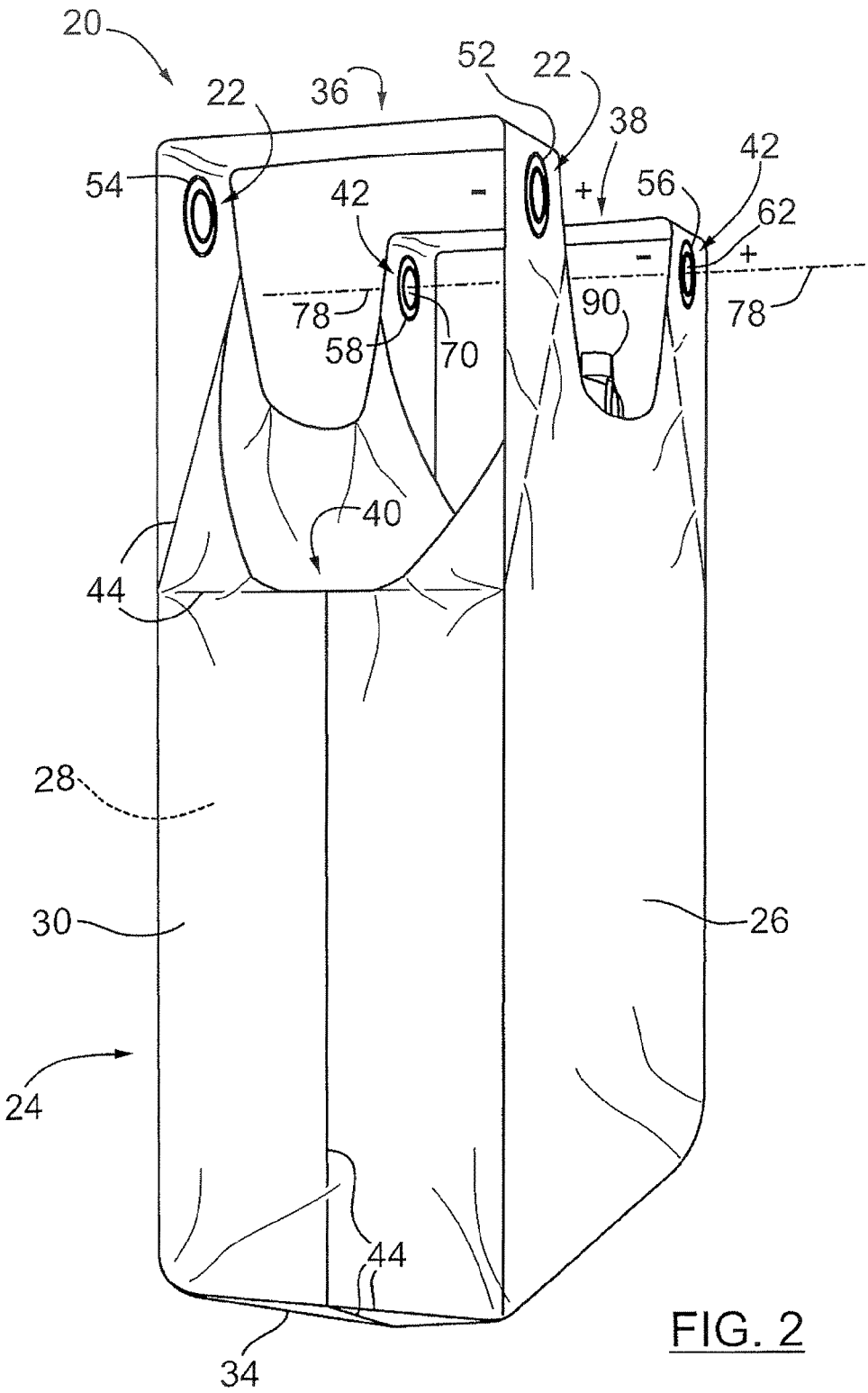
FIG. 2 shows a perspective view of the bag of FIG. 1 in an open configuration.

Reference is first made to FIGS. 1 and 2, which show a bag 20 in accordance with an example embodiment of the present invention. The bag 20 is for example a container for carrying goods, groceries, and the like. The bag 20 as shown includes two pairs of grommets 22, 42 including magnetic and/or ferromagnetic materials for closing of the bag 20, as well as for magnetically attracting to a like grommet of a like bag. This for example allows stacking and aligning of such bags in series, which may assist in storing and dispensing of the bags. While the embodiment shown in the attached Figures depicts first and second pairs of grommets 22, 42, it will be appreciated that in an alternate embodiment a single pair of grommets may be utilized.

The bag 20 includes an exterior shell 24 that may typically be formed from sheets of material and bag-shaped to define an interior for storage of goods. Thus, as shown, the shell 24 may include a front sheet 26, a back sheet 28, a left side sheet 30, a right side sheet 32 and a bottom sheet 34. The front sheet 26, back sheet 28, left side sheet 30, and right side sheet 32 extend upwardly from the bottom sheet 34 to a top of the bag 20. The front sheet 26 and the back sheet 28 are opposing and have a similar shape, while the left side sheet 30 and the right side sheet 32 are opposing and have a similar shape. The front sheet 26 may include a company logo (not shown) imprinted thereon.

As can be appreciated, reference to the various "sheets" of the shell 24 is used for convenience and may comprise part of larger unitary sheets which are suitably folded or creased, or include various smaller sheets which are attached (e.g., stitched, glued, etc.) together in various ways and in various configurations.

As shown, the shell 24 further defines an opening 40 for accessing of the interior of the bag 20. A first handle portion 36 is positioned at the opening 40 and defined by the intersection between the front sheet 26, the back sheet 28, and the left side sheet 30. Similarly, a second handle portion 38 is positioned at the opening 40 and defined by the intersection between the front sheet 26, the back sheet 28, and the right side sheet 32. The handle portions 36, 38 may therefore be formed from at least two layers of sheets, assisting in reinforcement thereof, as best shown in regards to first handle portion 36 in FIG. 2. To carry the bag 20, a user may hold both handle portions 36, 38 together with one hand. The shell 24 may be used in an open configuration or a closed configuration. FIG. 1 shows the closed configuration and FIG. 2 shows the open configuration. In the closed configuration, the front sheet 26 mates or contacts the back sheet 28 and the two sheets 26, 28 are generally aligned, thereby closing the opening 40 and generally preventing access to the interior of the shell 24. When doing so, the side sheets 30, 32 can be each folded inwards to facilitate the mating of the front sheet 26 and the back sheet 28. To assist in folding of the side sheets 30, 32, various preformed creases or folds, indicated generally as 44 for left side sheet 30, may also be defined in the side sheets 30, 32.

To facilitate closing the opening 40 (or at least a portion of the opening 40) and aligning of the front sheet 26 and the back sheet 28, the first pair of grommets 22 is located at the first handle portion 36 and includes a first magnetic grommet 52 within front sheet 26 and a second grommet 54 located opposite thereto and positioned within back sheet 28. Similarly, the second pair of grommets 42 is located at the second handle portion 38 and includes a third magnetic grommet 56 positioned in front sheet 26 and a fourth grommet 58 located opposite thereto and within back sheet 28. Generally, the first magnetic grommet 52 includes a positive ("+") pole facing forward and a negative ("−") pole facing the second grommet 54, while the second grommet 54 includes a ferromagnetic material, the grommets 52, 54 being positioned for closing of the opening 40 by magnetic attraction between the negative ("−") pole and the ferromagnetic material of the second grommet 54. Similarly, the third magnetic grommet 56 includes a positive ("+") pole facing forward and a negative ("−") pole facing the fourth grommet 58, while the fourth grommet 58 includes a ferromagnetic material. The grommets 56, 58 are positioned for closing of the opening 40 by magnetic attraction between the negative pole ("−") of the third magnetic grommet 56 and the ferromagnetic material of the fourth grommet 58. As can be appreciated, in the closed configuration the first pair of grommets 22 collectively form a magnetic field for magnetically interacting to an exterior of the shell 24 (e.g. with another like bag). The same may be said for the second pair of grommets 42. In the closed configuration, it can be appreciated that the second grommet 54 and the fourth grommet 58 and associated ferromagnetic materials may continue the magnetic fields created by the first magnetic grommet 52 and third magnetic grommet 56, respectively. Suitable ferromagnetic materials include but are not limited to iron and steel.

Referring still to FIG. 2, each of the magnetic grommets 52, 56 includes an opposing pole positioned to magnetically interact exterior to the shell 24. For example, referring to magnetic grommet 56, the positive ("+") pole, as shown, may for example be for magnetically attracting to another magnet (not shown) having a negative ("−") pole, or another ferromagnetic material. In some example embodiments, the magnetic grommet 56 may be attracted to other bags having a like magnetic grommet, as described in detail below.

Figure 3:
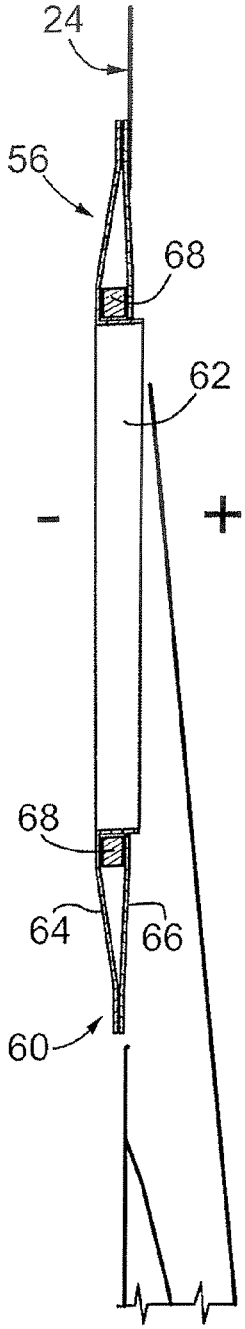
FIG. 3 a partial cross-sectional view of the bag taken along section lines 3-3 in FIG. 1, illustrating a detail view of a magnetic grommet.
Figure 4:
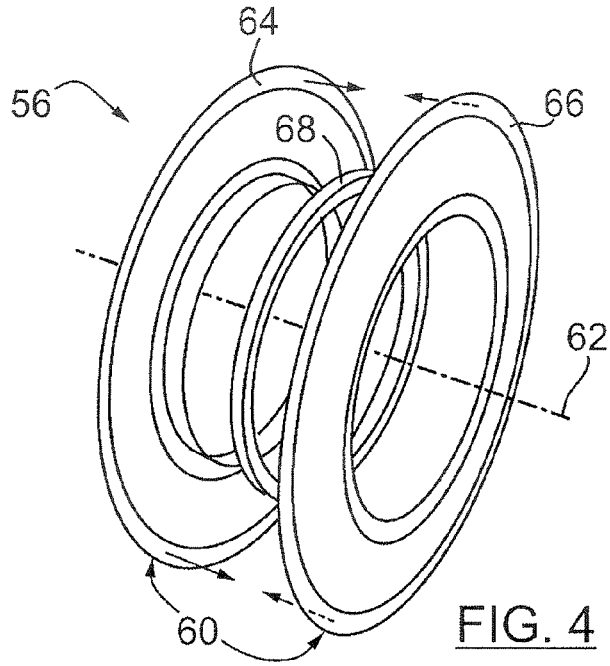
FIG. 4 shows an exploded perspective view of the magnetic grommet of FIG. 3.

Reference is now made to FIGS. 3 and 4, which show the magnetic grommet 56 in greater detail. The magnetic grommet 56 includes a conventional grommet which may be generally in the form of a ring 60, which includes an outer shell 66 and inner shell 64 of similar dimensions and which mate together for attaching or mounting to the shell 24. The ring 60 may provide some reinforcement to the sheets of the shell 24 and prevents fraying, etc. The ring 60 also defines a perimeter (e.g., a circumference in this example) which defines an aperture 62 therein. A circular magnet 68 is located between the outer shell 66 and the inner shell 64, and provides the magnetic poles as discussed above. The ring 60 may also be formed of a ferromagnetic material to continue the magnetic fields of the circular magnet 68.

Figure 5A:
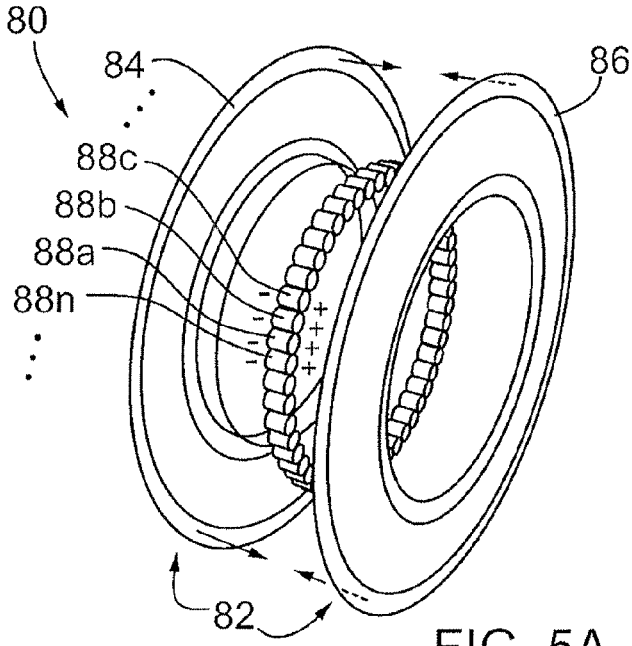
FIG. 5A shows an exploded perspective view of another magnetic grommet in accordance with a second example embodiment to be used in the bag of FIG. 1.

Reference is now made to FIG. 5A, which shows another magnetic grommet 80 in accordance with another example embodiment. As shown, the magnetic grommet 80 includes a ring 82 including an outer shell 86 and an inner shell 84. Between the outer shell 86 and the inner shell 84 is a number of small magnets 88*a*, 88*b*, 88*c*, . . . , 88*n*, which are in arranged in series in a generally circular configuration. As will be appreciated in the art, the small magnets 88*a*, 88*b*, 88*c*, . . . , 88*n* may collectively create magnetic fields (or magnetic poles). In this embodiment, the resultant magnetic fields generated from the magnets 88*a*, 88*b*, 88*c*, . . . , 88*n* may be similar or the same as those generated by magnetic grommet 56 (FIGS. 3 and 4).

Figure 5B:
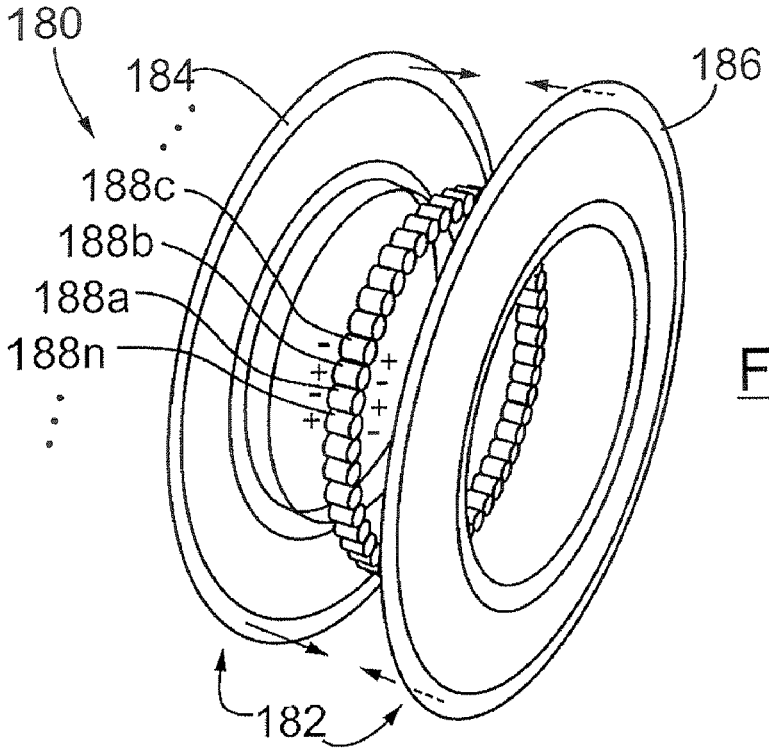
FIG. 5B shows an exploded perspective view of another magnetic grommet in accordance with a third example embodiment to be used in the bag of FIG. 1.

Reference is now made to FIG. 5B, which shows another magnetic grommet 180 in accordance with another example embodiment. As shown, the magnetic grommet 180 includes a ring 182 including an outer shell 186 and an inner shell 184. Between the outer shell 186 and the inner shell 184 is a number of small magnets 188*a*, 188*b*, 188*c*, . . . , 188*n*, which are in arranged in series in a generally circular configuration. The small magnets 188*a*, 188*b*, 188*c*, . . . , 188*n* may have poles which alternate. For example, small magnet 188*a* includes a positive ("+") pole directed towards outer shell 186, and a negative ("−") pole directed towards inner shell 184. Similarly, small magnet 188*b* includes a negative ("−") pole directed towards outer shell 186, and a positive ("+") pole directed towards inner shell 184. In this embodiment, the resultant magnetic fields generated from the magnets 188*a*, 188*b*, 188*c*, . . . , 188*n* allow the magnetic grommet 180 to magnetically attach to ferromagnetic materials. The magnetic grommet 180 may also attach to other like magnets, and would therefore be independent of the particular sides of the magnetic grommets, for example, without being reliant on particular poles.

Figure 5C:
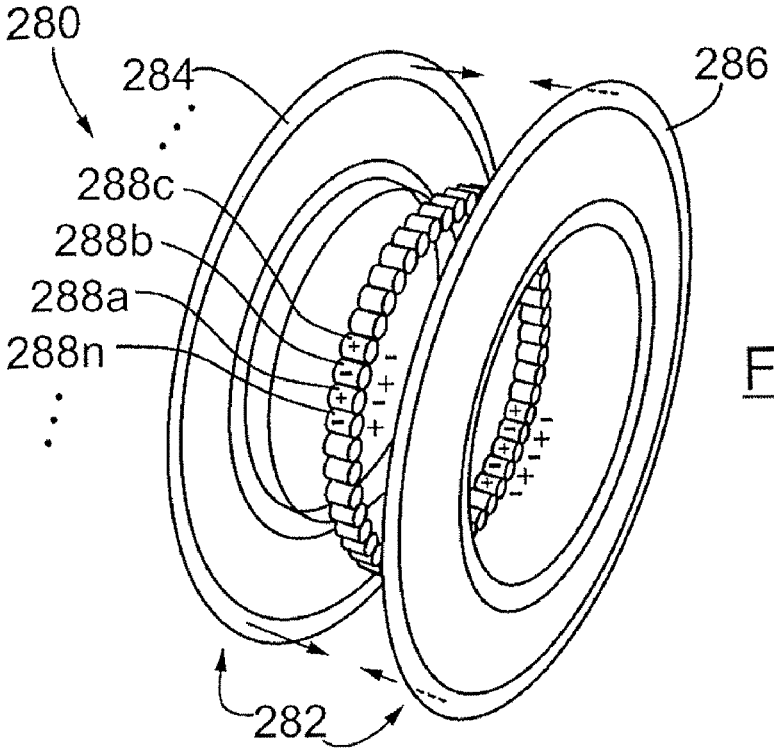
FIG. 5C shows an exploded perspective view of another magnetic grommet in accordance with a fourth example embodiment to be used in the bag of FIG. 1.

Reference is now made to FIG. 5C, which shows another magnetic grommet 280 in accordance with another example embodiment. As shown, the magnetic grommet 280 includes a ring 282 including an outer shell 286 and an inner shell 284. Between the outer shell 286 and the inner shell 284 is a number of small magnets 288*a*, 288*b*, 288*c*, . . . , 288*n*, which are in arranged in series in a generally circular configuration. The small magnets 288*a*, 288*b*, 288*c*, . . . , 288*n* may have poles which alternate. For example, small magnet 288*a* includes a positive ("+") pole directed towards an outer diameter of the ring 282, and a negative ("−") pole directed towards an inner diameter of the ring 282. Similarly, small magnet 288*b* includes a negative ("−") pole directed towards the outer diameter of the ring 282, and a positive ("+") pole directed towards the outer diameter of the ring 282. In this embodiment, similar to the magnetic grommet 180 shown in FIG. 5B, the resultant magnetic fields generated from the magnets 288*a*, 288*b*, 288*c*, . . . , 288*n* allow the magnetic grommet 180 to magnetically attach to ferromagnetic materials. The magnetic grommet 180 may also attach to other like magnets, and would therefore be independent of the particular sides of the magnetic grommets, for example, without being reliant on particular poles.

In yet another embodiment, one or more of the rings (not shown) may themselves be magnets (i.e., formed of magnetic material) rather than including a separate magnet or magnetic material.

As illustrated in FIGS. 1 and 2, the magnet poles or corresponding magnetic charges are referenced by using a conventional "+" and "−" referencing scheme, although it will be appreciated that other schemes may be used, for example using magnetic field lines or the Ampere model, as would be understood in the art. As also will be understood, the reference to such poles is used for convenience and may be used to merely refer to the two opposing sides of a magnet. Generally, as is known in the art, opposite magnetic poles attract, such as "+" and "−"; while same poles repel, for example "+" and "+", or "−" and "−". The magnetic poles are also sometimes referred to as "North" and "South" poles of the magnets. It will also be appreciated that at least some of the above-described poles could be opposite, e.g., magnetic grommets 52, 54 may both include a negative ("−") pole facing exterior, etc. In another example, magnetic grommet 52 includes a positive ("+") pole facing exterior while magnetic grommet 54 includes a negative ("−") pole facing exterior, or vice versa.

In yet further embodiments, one or both of the grommets 54, 58 may include a suitable magnetic material or magnet configuration in association with, or as an alternative to, the ferromagnetic material described above. The resultant magnetic grommet may for example be configured similar to the magnetic grommets as shown in FIGS. 3 and 4. Such an embodiment may for example result in a stronger magnetic attraction between the pairs of grommets 22, 42, and exterior magnetic attraction to like grommets.

Figure 6:
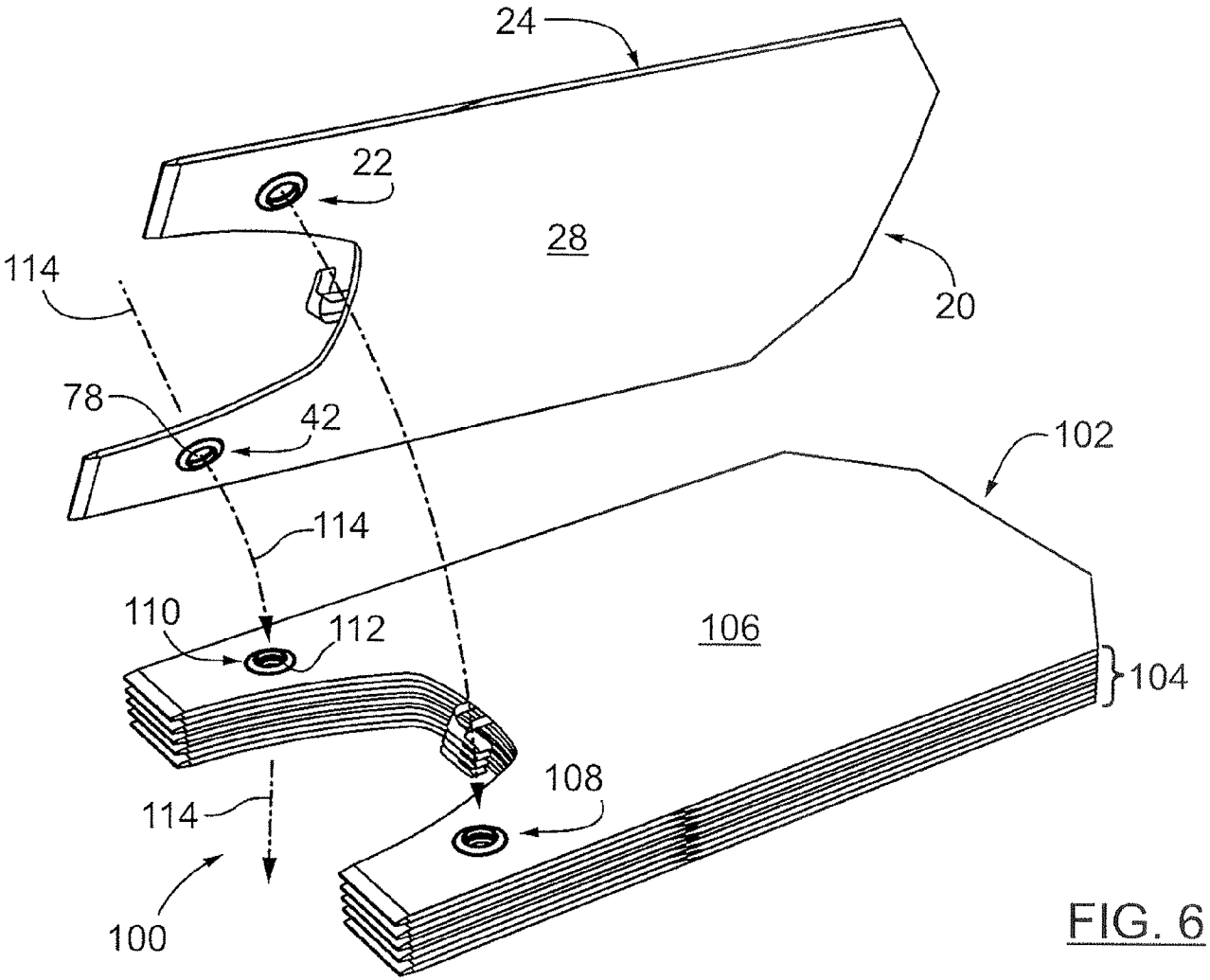
FIG. 6 shows an exploded perspective view of a bag system in accordance with an example embodiment, illustrating magnetic attraction between a series of bags.

Reference is now made to FIG. 6, which shows a bag system 100 in accordance with an example embodiment, illustrating magnetic attraction between a number of bags arranged in series. Similar reference numbers are used for convenience. Accordingly, the bag system 100 may include a first bag, for example being bag 20 (FIG. 1), a second like bag 102, and a plurality of other like bags, generally designated as 104.

The second bag 102 therefore includes a shell 106, a first pair of grommets 108 and a second pair of grommets 110, which may include magnetic and/or ferromagnetic materials, similar to that discussed above with respect to bag 20. As shown, the second bag 102 is magnetically attracted to and aligned with the first bag 20. In order to do so, the pair of grommets 22 of the first bag 20 is magnetically attracted to the pair of grommets 108 of the second bag 102. Similarly, the pair of grommets 42 of the first bag 20 is magnetically attracted to the pair of grommets 110 of the second bag 102. Accordingly, the first bag 20 is releasably secured to the second bag 102 via magnetic attraction. Because the first and second pairs of grommets 108, 110 are in a like position on the second bag 102 as in the first bag 20, the shell 24 of the first bag 20 will therefore be aligned with the shell 106 of the second like bag 102. A similar configuration is shown with respect to the plurality of other like bags 104.

A dispensing feature of the bag system 100 will now be briefly described, referring again to FIG. 2. The aperture 62 of the third magnetic grommet 56 is aligned with an aperture 70 of the fourth grommet 58. Both apertures 62, 70 will therefore define a collective aperture 78 which, for example is capable of receiving a support rod or shaft therethrough. In one embodiment, the bag system 100 may be carried by a hook (not shown) such as a carabiner hook which passes through the collective aperture 78. The hook (not shown) may be carried by a shoulder strap or personal bag (e.g., school bag or purse) having such hooks. Referring now to FIG. 6, the bags of the bag system 100 may be initially stored together for dispensing of the first bag 20. The aperture 78 defined by pair of grommets 42 on the first bag 20 is aligned with an aperture 112 defined by the pair of grommets 110 of the second bag 102. The apertures 78, 112, along with apertures of the plurality of other like bags 104, may therefore define a larger collective aperture 114, which for example receives a support rod or shaft therethrough.

Figure 7:
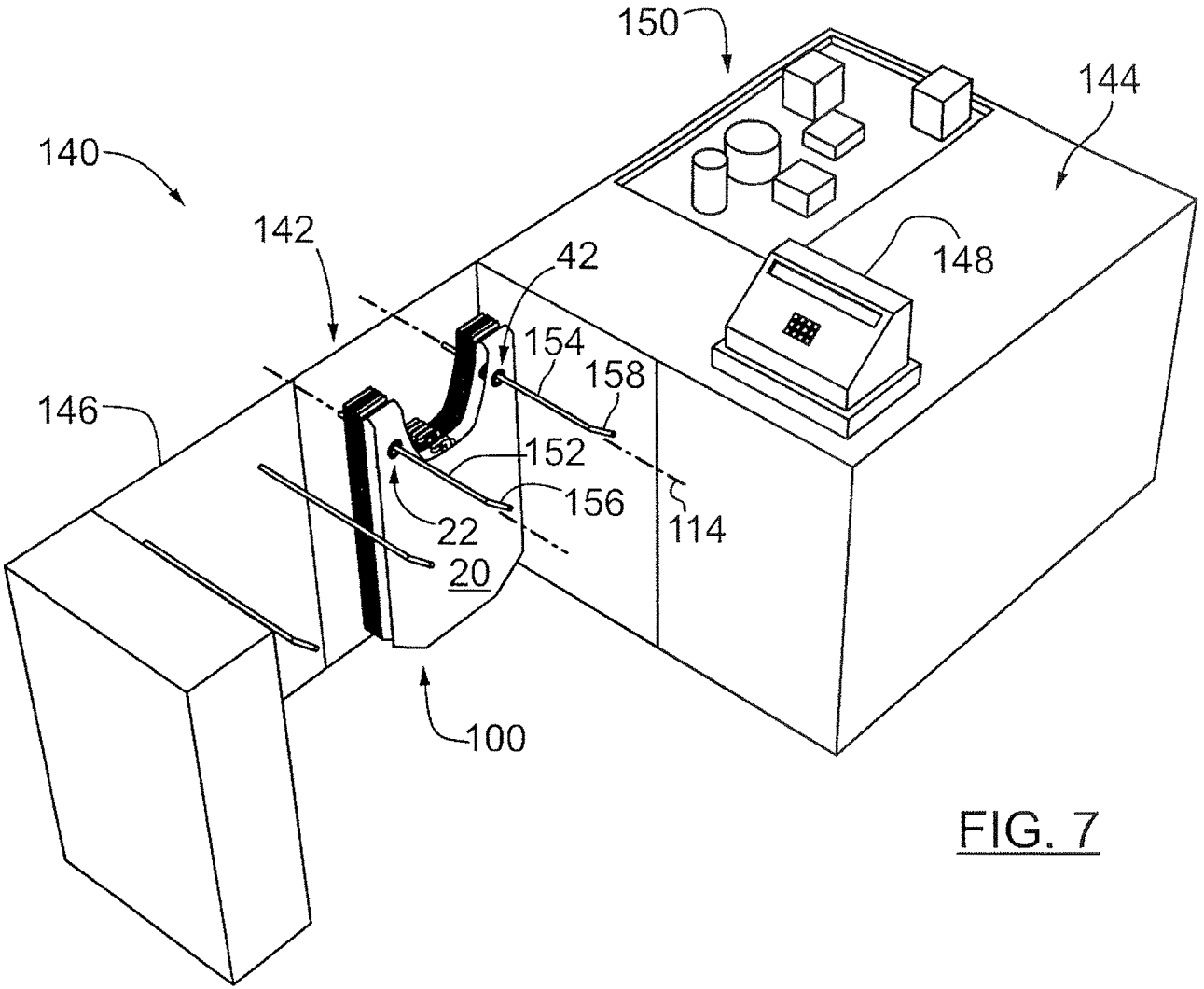
FIG. 7 illustrates a diagrammatic perspective view of a point-of-purchase system, including a dispensing system for the series of bags of FIG. 6.

Reference is now made to FIG. 7, which illustrates in diagrammatic form a point-of-purchase system 140, including a dispensing system 142 for the series of bags 100. The point-of-purchase system 140 includes a counter 144 which includes a vertical wall 146 having a generally vertically-oriented surface (i.e., the normal points horizontally). A cash register 148 is located atop the counter 144 for processing of payments, etc. Further, a number of retail goods 150 may be initially located atop the counter 144 for subsequent storage within one or more of the bags of the bag system 100.

The dispensing system 142 may include a support structure in the form of two support shafts 152, 154 extending generally horizontally from the vertical wall 146. The support shafts 152, 154 may for example be formed of a rigid material such as metal or a plastic material The support shafts 152, 154 are for storage and dispensing of the bag system 100. Thus as shown, the support shaft 154 extends through the collective aperture 114 of the bag system 100 (as described above). As shown, each bag of the bag system 100 is initially in the closed configuration (as described above) for storage of the bags. As can be appreciated, the bags of the bag system 100 are moveable (e.g., slideable) along a length of the support shafts 152, 154. The support shafts 152, 154 at their extremities further include an upwardly angled section 156, 158 for helping to prevent the bags of the bag system 100 from sliding off.

Figure 8:
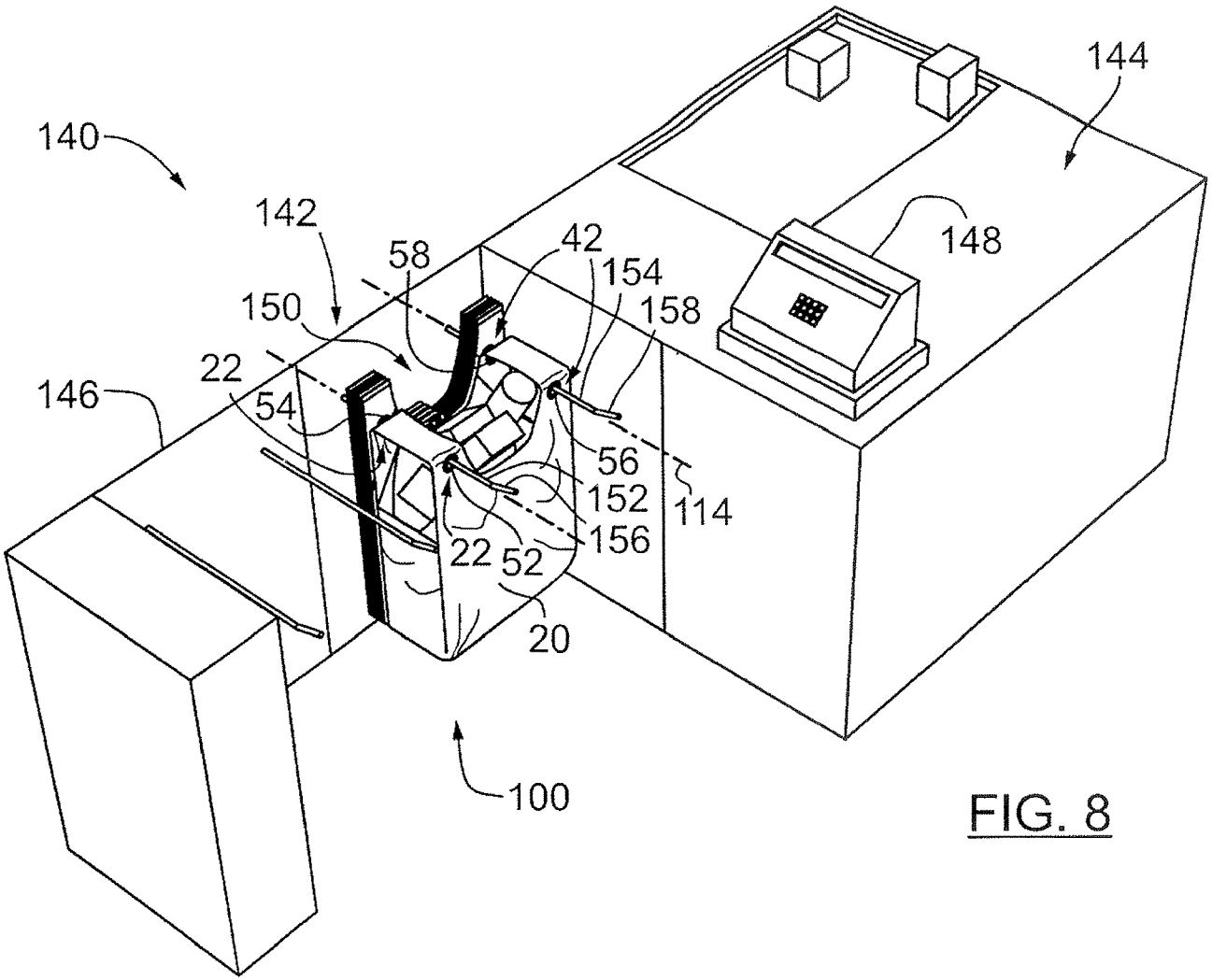
FIG. 8 shows the point-of-purchase system of FIG. 7 in a dispensing operation.

FIG. 8 shows the point-of-purchase system of FIG. 7 in a dispensing mode of operation. As shown, the first bag 20 may be opened to the open configuration (discussed above) by applying sufficient force to break the magnet attraction between the pairs of grommets 22, 42, and sliding each of magnetic grommets 52, 56 along their respective support shafts 152, 154. Note that the grommets 54, 58 remain in place by way of magnetic attraction with the corresponding grommets on the adjacent bag. In the open configuration as shown, at least some of retail goods 150 may be inserted into the first bag 20, for example by a cashier or a customer. The first bag 20 may thereafter be removed from the support shafts 152, 154 and carried by the handles 36, 38 (FIG. 1). This may be repeated for any additional retail goods 150.

In some example embodiments the first bag 20 may also be returned to the closed configuration, by sliding the magnetic grommet 52, 56 back along the respective support shafts 152, 154 and once again magnetically engaging respective grommets 54, 58.

In further example embodiments, other magnets (not shown) or ferromagnetic material (not shown) may be located at the vertical wall 146 or at an end of the support shafts 152, 154 adjacent to the vertical wall 146. The other magnets (not shown) or ferromagnetic material (not shown) may be used for magnetically attracting to the magnetic grommets of the bag system 100, which may for example assist in storage and maintaining the bags in place.

Figure 9:
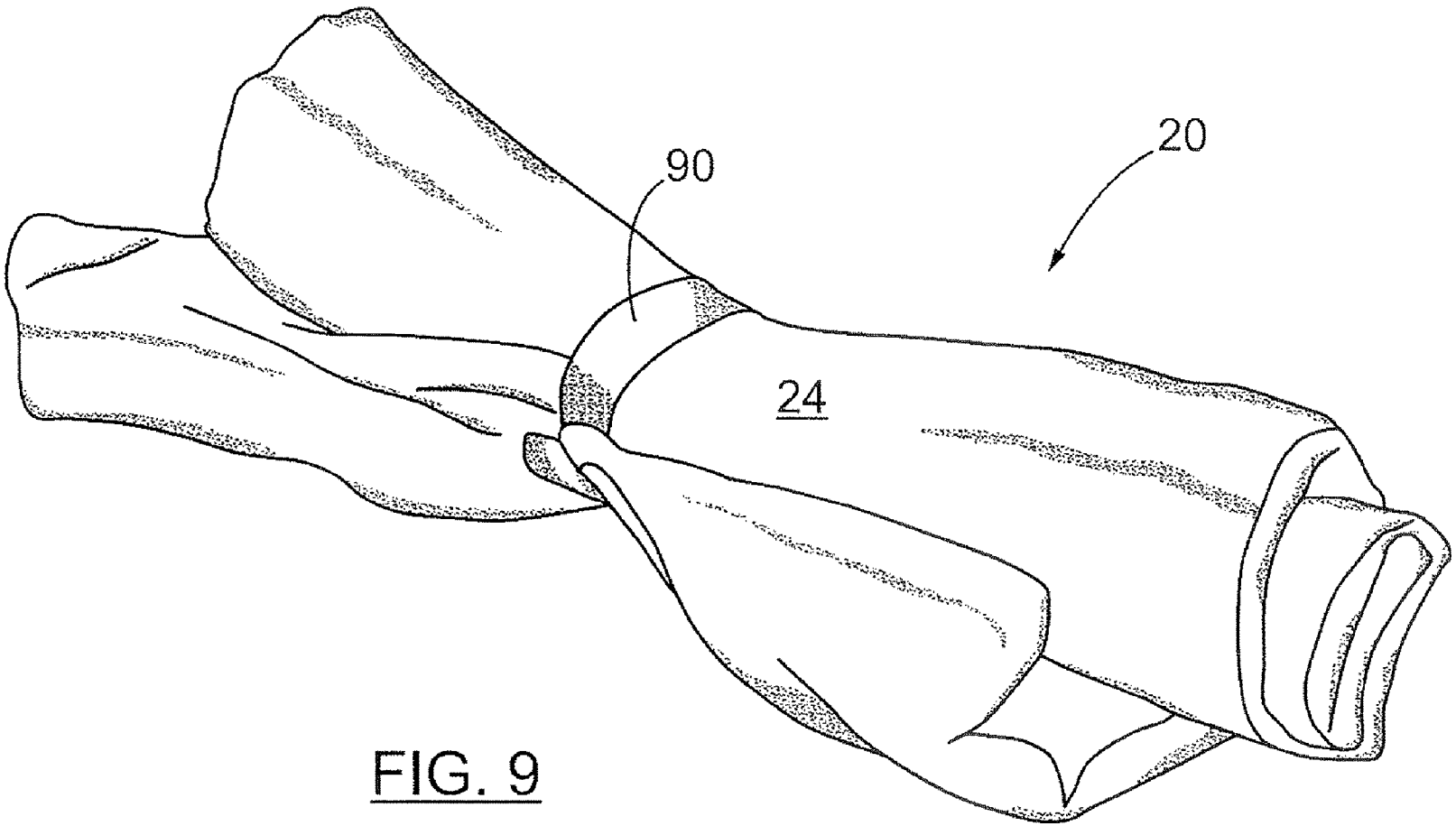
FIG. 9 shows a perspective view of a storage configuration of the bag of FIG. 1.

Reference is now made to FIGS. 1 and 9 which show a storage configuration of the bag 20. A flexible strap 90 may be located at the opening 40 of the shell 24 of the bag 20, for surrounding of the shell 24 when rolled or folded. In its closed configuration, the bag 20 may initially be vertically folded with the folding maintained via magnetic attraction between magnetic grommets 52 and 56. Referring now to FIG. 9, further folds, rolls, and wraps may be made to the bag 20 to arrive at the storage configuration shown. The flexible strap 90 may thereafter be used to surround the shell 24 when rolled or folded, as shown.

The shell 24 may be formed of flexible material which may be wrappable. In some example embodiments the bag 20 may be a reusable bag and generally sturdy materials may be used. Suitable materials include but are not limited to plastic, fabric, or leather based materials.

Variations may be made to some of the example embodiments described herein. Such variations may include combinations and sub-combinations of any of the above. It will be appreciated that, while some embodiments are described in terms of systems, those embodiments may similarly apply to methods, and vice versa.

The grommets may also be dimensioned in various other shapes, aside from ring-shaped members. For example, the grommets may be oval, football shaped, arc or hook shaped, half-moon shaped, or semi-circular shaped (with the curved portion at the top and the flat portion at the bottom). Similarly, the cross-sectional shape of the support shafts 152, 154 may be shaped to generally correspond to the aperture shape defined by the grommet.

The apertures of the grommets may be dimensioned to have a diameter of about ¾ inches or less. Thus, in such instances the grommets do not interfere with the handle portions 36, 38 (FIG. 1). This sizing for such grommets for example uses less material than would be required for larger diameters.

In addition, the dispensing system 142 may be utilized at other locations or configurations for the storage and/or dispensing of the bags. For example, only one support shaft is required if the bag is limited to one pair of grommets. In some example embodiments, the support shafts 152, 154 may be located at a vehicle such as in a trunk of a car, a warehouse, a shopping cart, a personal bag, etc. In another embodiment, the support shafts 152, 154 are mounted vertically rather than horizontally, or at other suitable angles. In another example, a carabiner hook (not shown) may be used wherein part of a loop portion of the hook is configured as a support shaft.

While example embodiments have been described in detail in the foregoing, it will be understood by those skilled in the art that variations may be made while remaining within the broad scope of the invention.

What is claimed is:

1. A container, comprising:

a container shell defining an interior therein and having an opening for accessing the interior;

a first grommet and a second grommet each located on the container shell and each including a perimeter that defines an aperture through said grommet, the second grommet including a magnetic or a ferromagnetic material; and, a first magnet within the first grommet, the first grommet and the second grommet positioned on the container shell to assist in closing the opening by magnetic attraction between the first magnet and the magnetic or ferromagnetic material, when said opening is closed said grommets are held in a position wherein said apertures are in general alignment;

wherein the apertures of the first and second grommets may be aligned on the container shell to define a collective aperture, the collective aperture being dimensioned for receiving a support structure therethrough.

2. A container as claimed in claim 1, wherein the first magnet is included within the perimeter of the first grommet.

3. A container as claimed in claim 2, wherein the first grommet is moveable along a length of the support structure to open and close the opening of the container.

4. A container as claimed in claim 3, wherein the support structure includes an elongate shaft and the apertures of the grommets are shaped to receive the elongate shaft.

5. A container as claimed in claim 1, wherein the first magnet is further positioned to magnetically interact exterior to the container shell, and wherein the first magnet is for magnetic attraction to a like magnet of a like container.

6. A container as claimed in claim 1, wherein the container shell includes at least one handle portion, the first grommet and the second grommet being positioned at one handle portion of the at least one handle portion.

7. A container as claimed in claim 1, further comprising a third grommet and a fourth grommet located on the container shell.

8. A container as claimed in claim 6, further comprising a second magnet within the third grommet, the fourth grommet including a second magnetic or a ferromagnetic material, the third grommet and the fourth grommet positioned on the container shell to assist in closing of the opening by magnetic attraction between the second magnet and the second magnetic or ferromagnetic material of the fourth grommet, the second magnet being further positioned to magnetically interact exterior to the container shell.

9. A container as claimed in claim 1, wherein the container shell includes a front sheet and a back sheet having a similar shape as the front sheet, the first grommet being positioned on the front sheet and the second grommet being positioned on the back sheet opposite of the first grommet for aligning of the front sheet and back sheet when the opening is closed.

10. A container as claimed in claim 1, wherein the container shell is formed of sheets of flexible material.

11. A container as claimed in claim 9, further comprising a strap positioned at the opening for surrounding of the container shell when the container shell is folded or rolled.

12. A method of using of a container, the container including a container shell defining an interior therein and having an opening for accessing the interior, a first magnet, and a magnetic or a ferromagnetic material, the first magnet and the magnetic or ferromagnetic material positioned on the container shell to assist in closing the opening by magnetic attraction therebetween, the first magnet being positioned on the container shell to magnetically interact exterior to the container shell, the method comprising magnetically attracting the first magnet to a like second container to releasably secure the container shell to the like second container, wherein the container includes a first grommet and a second grommet, the first grommet including a first perimeter that defines a first aperture through said first grommet, the first grommet including the first magnet, and the second grommet including a second perimeter that defines a second aperture through said second grommet, the second grommet including said magnetic or a ferromagnetic material.

13. A method as claimed in claim 11, wherein the first and second apertures of the first and second grommet are aligned on the container shell to define a collective aperture, further comprising receiving a support structure through the collective aperture.

14. A method as claimed in claim 12, wherein the first and second grommet are positioned on the container shell for closing of the opening by magnetic attraction therebetween, the method further comprising moving the first grommet along a length of the support structure to open and close the opening of the container.

15. A container system, comprising:

a first container including a first container shell defining a first interior therein and having a first opening for accessing the first interior, a first magnet, and a first magnetic or ferromagnetic material, the first magnet being positioned on the first container shell to magnetically interact exterior to the first container shell; and, a second container including a second container shell defining a second interior therein and having a second opening for accessing the second interior, a second magnet, and a second magnetic or ferromagnetic material, the second magnet being positioned on the second container shell to magnetically interact exterior to the second container shell, the first magnet being magnetically attracted to the second magnet to releasably secure the first container shell to the second container shell, wherein the first container includes a first grommet pair having a first grommet including a first perimeter that defines a first aperture through said first grommet and a second grommet including a second perimeter that defines a first aperture through said second grommet, the first grommet including the first magnet and the second grommet including the first magnetic or ferromagnetic material; and wherein the second container includes a second grommet pair including a third grommet including a third perimeter that defines a third aperture through said third grommet and a fourth grommet including a fourth perimeter that defines a fourth aperture through said fourth grommet, the third grommet including the second magnet and the fourth grommet including the second magnetic or ferromagnetic material.

16. A container system as claimed in claim 13, wherein the first magnet and the first magnetic or ferromagnetic material are positioned on the first container shell to assist in closing of the first opening by magnetic attraction therebetween, and wherein the second magnet pair and the second magnetic or ferromagnetic material are positioned on the second container shell to assist in closing of the second opening by magnetic attraction therebetween.

17. A container system as claimed in claim 13, wherein the apertures of the first and second grommet pairs may be aligned on the container shell to define a collective aperture, the container system further comprising a support structure dimensioned for extending through the collective aperture.

18. A container system as claimed in claim 15, wherein the support structure includes an elongate shaft and the first, second, third and fourth perimeters are shaped to receive the elongate shaft.

19. A container system as claimed in claim 16, wherein an end of the support structure includes an angled section.

* * * * *